US006029699A

United States Patent [19]

Granot

[11] Patent Number: 6,029,699

[45] Date of Patent: Feb. 29, 2000

[54] WATER TAP CONSTRUCTION

[76] Inventor: Yoav Granot, 3F Moshav, Adanim 45 925, Israel

[21] Appl. No.: 09/192,374

[22] Filed: Nov. 16, 1998

[30] Foreign Application Priority Data

Feb. 18, 1998 [IL] Israel ..... 123348

[51] Int. Cl.[7] ..... F16K 11/06

[52] U.S. Cl. ..... 137/607; 137/565.12; 137/625.41

[58] Field of Search ..... 137/607, 625.41, 137/565.12, 606; 251/129.04

[56] References Cited

U.S. PATENT DOCUMENTS

| | | | |
|---|---|---|---|
| 3,752,452 | 8/1973 | Iannelli | 261/52 |
| 3,757,814 | 9/1973 | Hill | 137/268 |
| 4,077,545 | 3/1978 | Karls | 137/625.41 |
| 4,482,509 | 11/1984 | Iannelli | 137/115 |
| 4,518,541 | 5/1985 | Harris | 261/27 |
| 4,597,509 | 7/1986 | Pereira | 222/129 |
| 4,660,740 | 4/1987 | Brandon et al. | 137/539 |
| 5,021,250 | 6/1991 | Ferguson | 222/189 |
| 5,050,640 | 9/1991 | Cowley | 137/606 |
| 5,170,944 | 12/1992 | Shirai | 251/129.04 |
| 5,205,313 | 4/1993 | Moretti | 137/606 |
| 5,293,901 | 3/1994 | Guzzini | 137/607 |
| 5,324,434 | 6/1994 | Oikawa et al. | 210/87 |
| 5,417,348 | 5/1995 | Perrin et al. | 137/606 |

FOREIGN PATENT DOCUMENTS

| | | | |
|---|---|---|---|
| 2073371 | 10/1981 | United Kingdom | 137/565.12 |

*Primary Examiner*—Stephen M. Hepperle
*Attorney, Agent, or Firm*—Benjamin J. Barish

[57] ABSTRACT

A water tap particularly for kitchen sinks includes a body member attachable to the kitchen sink and having first and second ports for connection to hot and cold water supply lines, respectively, of the kitchen sink and a third port for connection to a third water supply line; and a handle rotatably mounted about a longitudinal axis with respect to the body member and operatively connected to a valve assembly such that: (a) rotating the handle to a selected position within a first operating region connects the first and second ports to a mixing chamber and controls the proportions of the hot and cold water supplied to the mixing chamber from the respective hot and cold water supply lines for discharge through a spout; and (b) rotating the handle to a selected position within a second operating region connects the third port to the spout for discharging water from the third water supply line.

20 Claims, 6 Drawing Sheets

FIG. 3
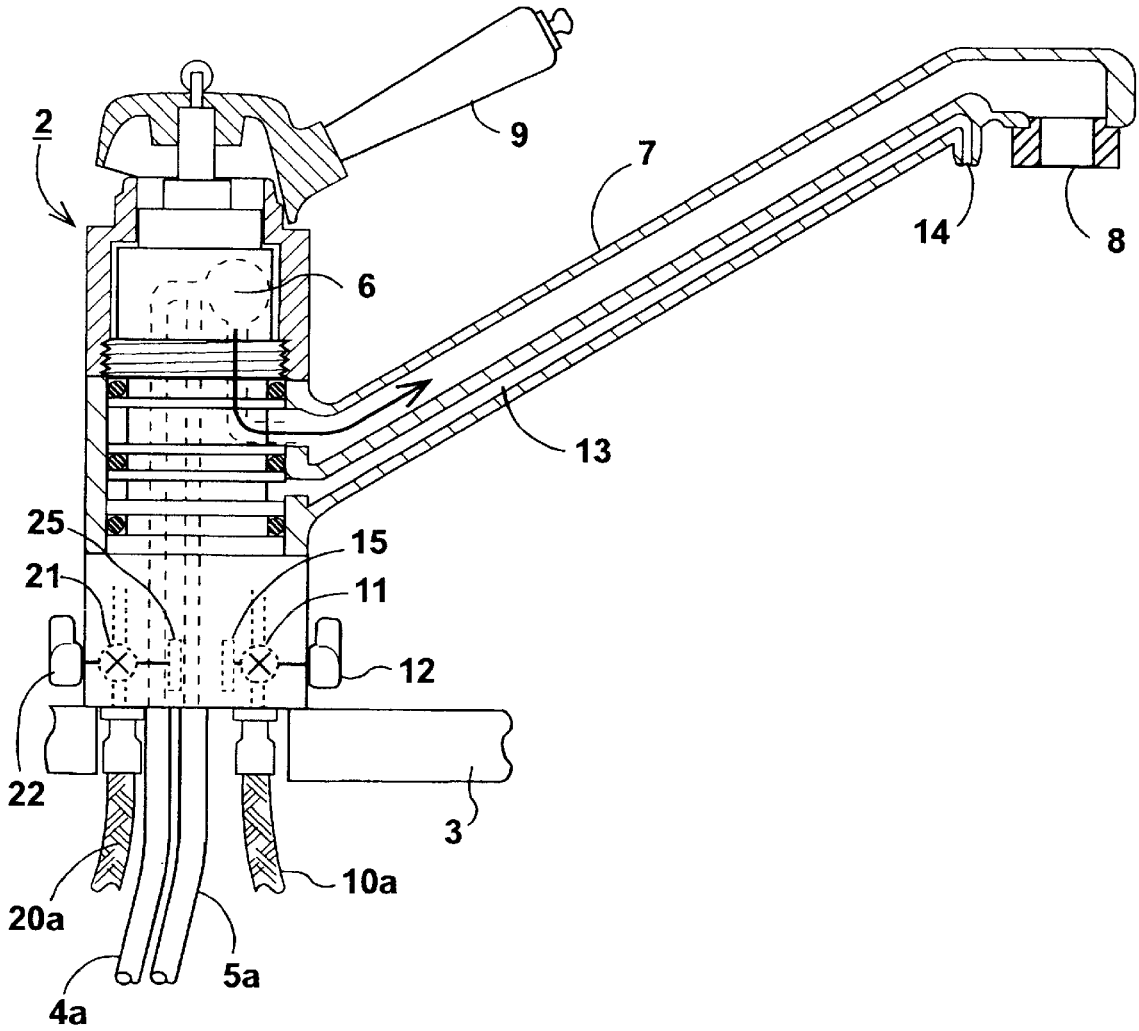
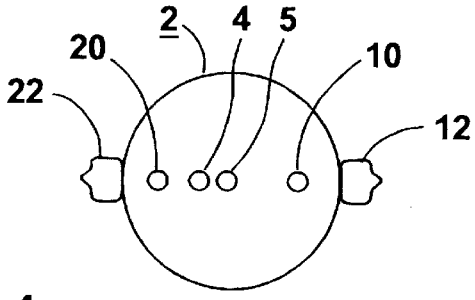
FIG. 4

WATER TAP CONSTRUCTION

FIELD AND BACKGROUND OF THE INVENTION

The present invention relates to water taps, and particularly to water taps for kitchen sinks.

The typical water tap for kitchen sinks comprises a body member attachable to the kitchen sink and having first and second ports for connection to the hot and cold water supply lines, respectively, of the kitchen sink; a mixing device coupled to the first and second ports for mixing the water therefrom; a discharge nozzle for discharging the mixed water from the tap; and a manual valve for controlling the water flow from the first and second ports to the mixing device and discharge nozzle.

In recent years, there has been a growing tendency to use treated water, e.g., water which has undergone special filtering treatments to remove foreign particles therefrom. Special installations are usually required for supplying such treated water, which involves a significant installation expense. U.S. Pat. No. 5,417,348 discloses a water tap capable of also dispensing filtered water besides the regular hot and cold water, but that water tap includes separate valves, each having its own manually-controlled valve operator, for each of the hot water, cold water and filtered water supplies.

OBJECTS AND BRIEF SUMMARY OF THE INVENTION

An object of the present invention is to provide a water tap particularly for kitchen sinks having an improved construction for selectively dispensing a third liquid, such as treated water, carbonated water, or a beverage, in addition to the normal hot and cold water, which tap includes a common manual operator which may be conveniently manipulated to make the selection. Another object of the invention is to provide a water tap particularly for kitchen sinks which may be used for selecting a third liquid, in addition to the normal hot and cold water, and which controls an electrical circuit in response to the selection to indicate the selection, and/or to control a pump or other electrical device in response to the selection.

According to one aspect of the present invention, there is provided a water tap particularly for kitchen sinks, comprising a body member attachable to the kitchen sink and having first and second ports for connection to hot and cold water supply lines, respectively, of the kitchen sink; a spout for discharging water from the tap; a mixing chamber having an inlet communicating with the first and second ports for mixing the water therefrom, and an outlet communicating with the spout; a third port for connection to a third water supply line; a valve assembly for selectively controlling the discharge of water from the mixing chamber and third port through the spout; and a handle rotatably mounted about a longitudinal axis with respect to the body member and operatively connected to the valve assembly such that: (a) rotating the handle to a selected position within a first operating region connects the first and second ports to the mixing chamber and controls the proportions of the hot and cold water supplied to the mixing chamber from the respective hot and cold water supply lines for discharge through the spout; and (b) rotating the handle to a selected position within a second operating region connects the third port to the spout for discharging through the spout water from the third water supply line.

According to further features in the described preferred embodiments, the handle is also pivotally mounted about a transverse axis with respect to the body member, and is operatively connected to the valve assembly such as to control, by its pivotal movement, the flow rate of the water flow from the mixing chamber to the spout when the handle is in the first operating region, and also the flow rate of the water flow from the third inlet port to the spout when the handle is in the second operating region.

According to another aspect of the present invention, there is provided a water tap particularly for kitchen sinks, comprising: a body member attachable to the kitchen sink and having first and second ports for connection to hot and cold water supply lines, respectively, of the kitchen sink; a spout for discharging water from the tap; a mixing chamber having an inlet communicating with the first and second ports for mixing the water therefrom, and an outlet communicating with the spout; a third port for connection to a third liquid supply line; manual valve means for selectively controlling the discharge of water from the mixing chamber and third port through the spout; an electrical switch actuated by the valve means when selecting the discharge of water from the third port; and an electrical circuit actuated by the electrical switch in response to the selection.

For example, the electrical circuit could include a light indicator which is energized to indicate when the manual valve means has been operated to dispense the third liquid. The electrical circuit could also include an electromagnetically-operated valve which is energized to control the third liquid supply line, or a pump which is energized to pump the third liquid from the third liquid source.

According to a further embodiment of the invention described below, the tap further comprises a fourth port for connection to a fourth, liquid supply line, selectable by the manual valve means.

As will be described more particularly below, a water tap constructed in accordance with the foregoing features is capable of dispensing, not only water from the conventional hot and cold water supply lines, but also other liquids, such as specially-treated water, carbonated water, beverages, and the like, in an efficient and convenient manner.

Further features and advantages of the invention will be apparent from the description below.

BRIEF DESCRIPTION OF THE DRAWINGS

The invention is herein described, by way of example only, with reference to the accompanying drawings, wherein:

FIGS. 3 and 4 are views similar to FIGS. 1 and 2, respectively, but illustrate a second embodiment of the invention enabling the water tap to dispense two liquids apart from the normal hot and cold water;

DESCRIPTION OF PREFERRED EMBODIMENTS

Figure 1:
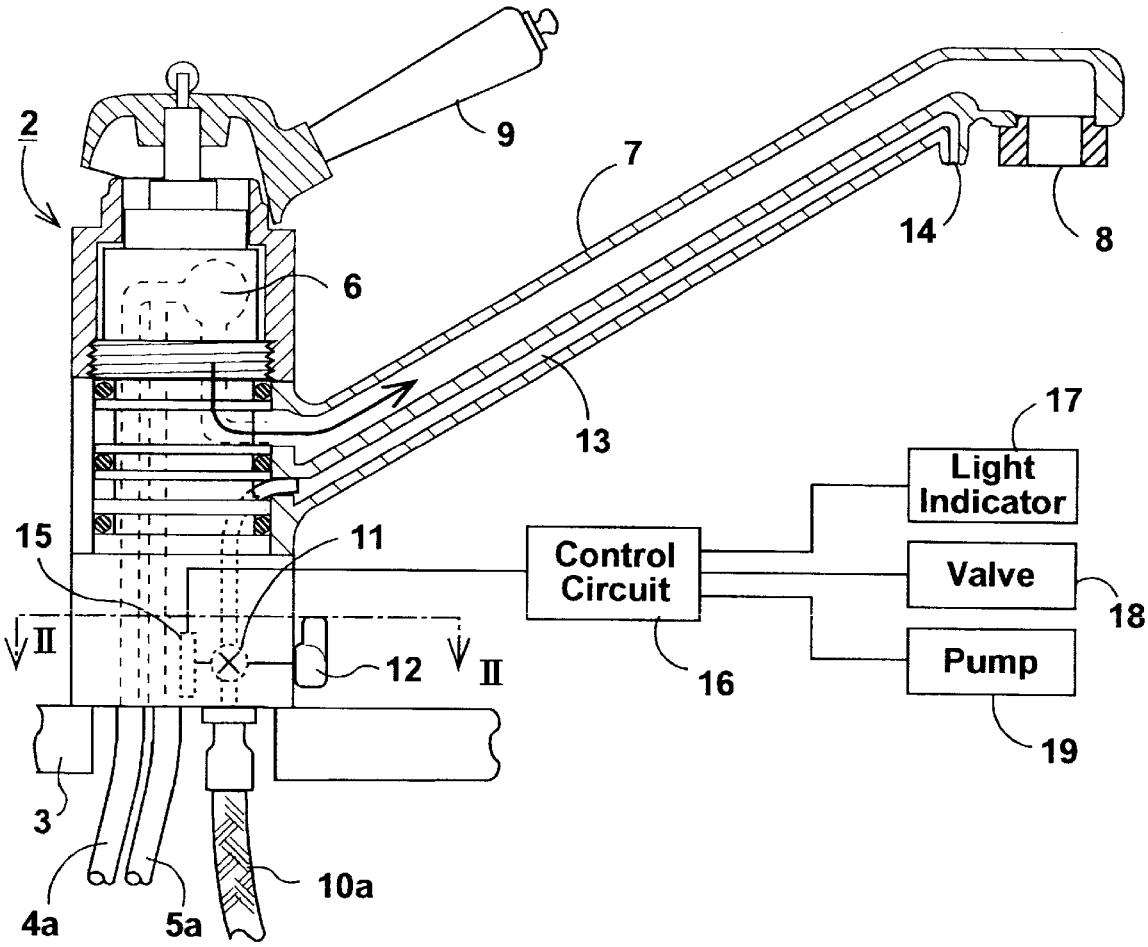
FIG. 1 illustrates one form of water tap constructed in accordance with the present invention.
Figure 2:
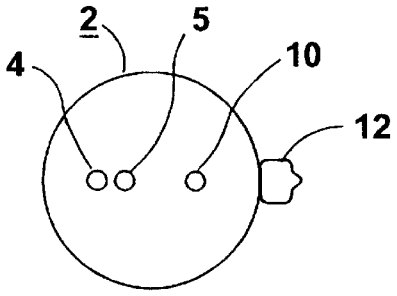
FIG. 2 is a view along line II—II of FIG. 1 showing the various ports provided in the water tap of FIG. 1.

The water tap illustrated in FIGS. 1 and 2 comprises a body member, generally designated 2, attachable to the kitchen sink 3. As shown in FIG. 2, body member 2 includes a first port 4 for connection to the hot water supply line 4*a* (FIG. 1), and a second port 5 for connection to the cold water supply line 5*a*. Body member 2 further includes a mixing chamber 6 for mixing the hot and cold water before passing the water via a spout 7 to a discharge nozzle 8. The amount of water discharged, and the hot and cold water proportions of the water discharged, are both controlled by a faucet handle 9.

Insofar as described above, such water taps are well known, and therefore further details of its construction and operation are not set forth herein.

According to the present invention, body member 2 further includes a third port, generally designated 10 in FIG. 2 for connection to a third liquid supply line, shown as 10*a* in FIG. 1. Such a third liquid may be pure water which has been previously treated and/or filtered. Alternatively, it could be another liquid, such as carbonated water, a beverage, or the like.

The third liquid supplied via the third liquid supply line 10*a* and port 10 in body member 2 is controlled by a manual valve 11 having a valve operator 12 rotatably mounted on the body member. The third liquid is supplied via a feed tube 13 extending through spout 7 to a second discharge nozzle 14 at the end of the spout. Valve 11 would be manually opened whenever it is desired to supply the third liquid from supply line 10*a* to the discharge nozzle 14.

Thus, when the user wishes to dispense water from the normal hot and cold water supply lines 4*a*, 5*a*, the user would operate the conventional faucet handle 9 to discharge the water from discharge nozzle 8 in the conventional manner, while valve 11 would be in its closed condition. When the user wishes to dispense the specially-treated water, or other liquid, from the liquid supply line 10*a*, faucet handle 9 would be closed, and manual valve 11 would be opened via its operator 12, whereupon the specially-treated water from supply line 10*a* would be supplied via discharge nozzle 14.

Valve 11 controlled by valve operator 12 may be of any conventional construction. For example, valve 11 could be a ball-type valve, i.e., a ball provided with a through-going bore which ball is rotated to aline the bore with liquid passageways in body member 2 on opposite sides of the valve when the valve is in its opened condition.

FIG. 1 illustrates further features which can be included in the water tap, to enable the water tap also to perform certain electrical-control operations. Thus, as shown in FIG. 1, valve operator 12 not only controls valve 11, but also controls electrical switch, generally designated 15, such as a magnetic reed switch, connected to a control circuit 16 which may control a number of devices. For purposes of example, FIG. 1 illustrates control circuit 16 as controlling a visual light indicator 17, to indicate that valve 11 has been opened to produce a discharge of liquid from line 10*a* to discharge nozzle 14; an electromagnetically-actuated valve 18 to control the third liquid supply line 10*a*; and/or a pump 19 which is actuated to pump the third liquid from a third liquid supply source via line 10*a* to dischatrge nozzle 14.

FIGS. 3 and 4 illustrate a modification wherein, in addition to the third-liquid port 10 connected to the third liquid supply line 10*a*, there is also included a fourth liquid port 20 connected to a fourth liquid supply line 20*a*. For example, the third liquid may be hot treated water and the fourth liquid may be cold treated water; alternatively, the third liquid could be treated water, and the fourth liquid could be carbonated water, or a beverage.

The tap illustrated in FIGS. 3 and 4 also includes, in addition to valve 11 and operator 12, a further valve 21 and operator 22 for controlling the fourth liquid supply. The fourth liquid is also supplied via tube 13 passing through spout 7 to discharge nozzle 14, as the third liquid.

FIG. 3 illustrates the further modification wherein an electrical switch 25 is provided in body member 2 under the control of operator 22 of valve 21 for controlling the electrical circuit, in addition to switch 15 under the control of operator 12 of valve 11 as described above with respect to FIG. 1. For example, electrical switch 15 could be used to energize one light indicator, such as indicator 17 in FIG. 1, to indicate when valve operator 12 is in its open condition for supplying liquid from line 10*a*; and switch 26 could be used for controlling a corresponding light indicator (not shown) to indicate when operator 22 is in its open condition for supplying liquid from the fourth liquid supply line 20*a*.

Figure 5:
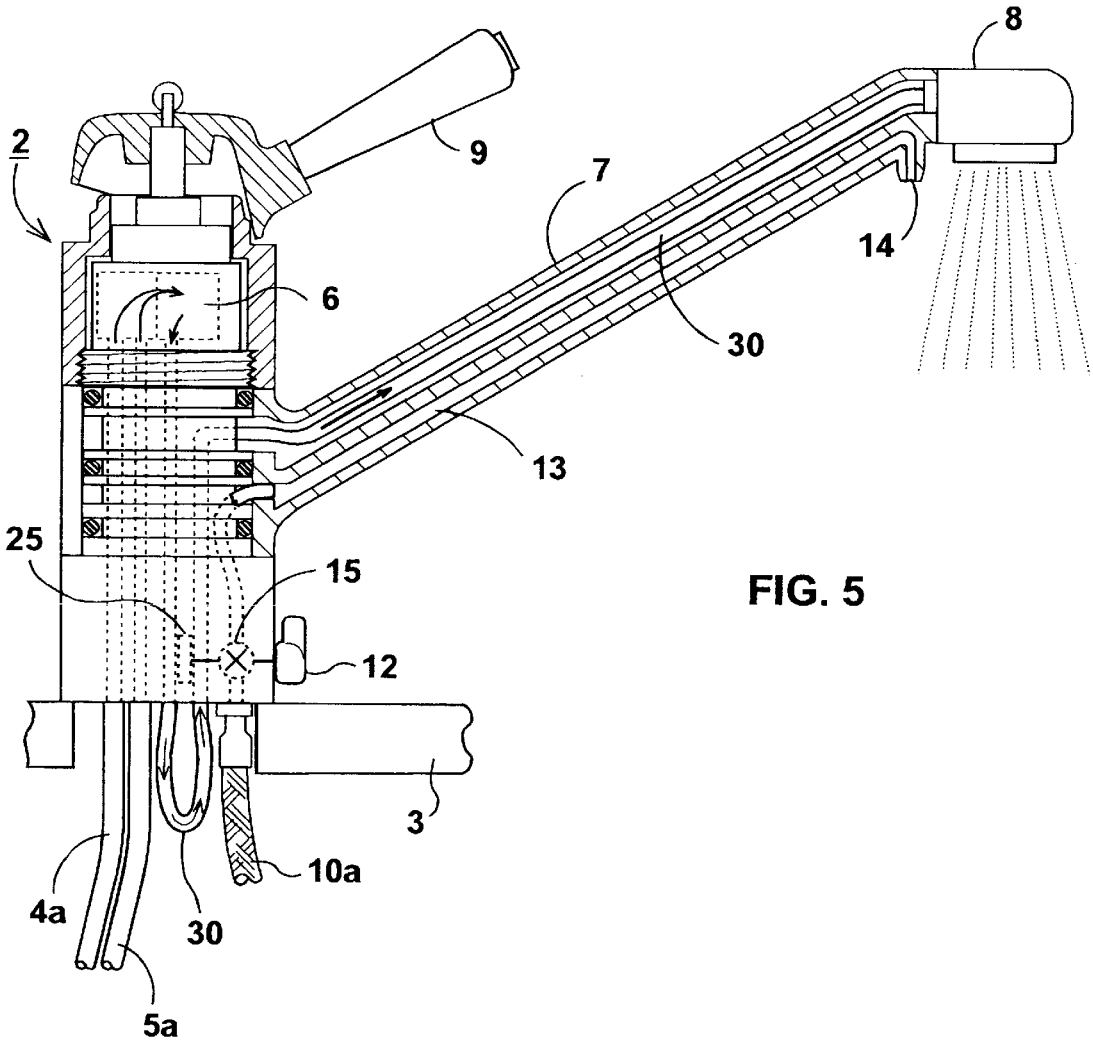
FIGS. 5 and 6 are views, corresponding to FIGS. 1 and 2, respectively, of a third embodiment of the invention enabling the water tap also to be used as an extensible spray head.

FIG. 5 illustrates a water tap of similar construction as in FIGS. 1 and 2, except that discharge nozzle 8 is in the form of a spray head and is connected to the mixing battery 6 by an extensible hose 30 which extends through spout 7 to the spray head containing discharge nozzle 8. Thus, the spray head may be manually removed and used, for example, for rinsing dishes or the like.

Figure 6:
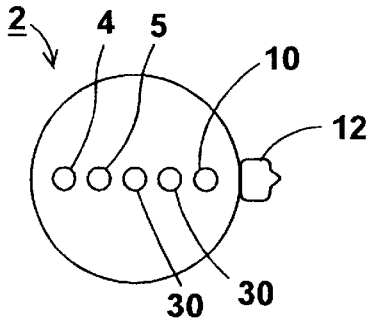

In all other respects, the water tap illustrated in FIGS. 5 and 6 is constructed and operates in the same manner as described above with respect to FIGS. 1 and 2, or with respect to FIGS. 3 and 4.

Figure 7:
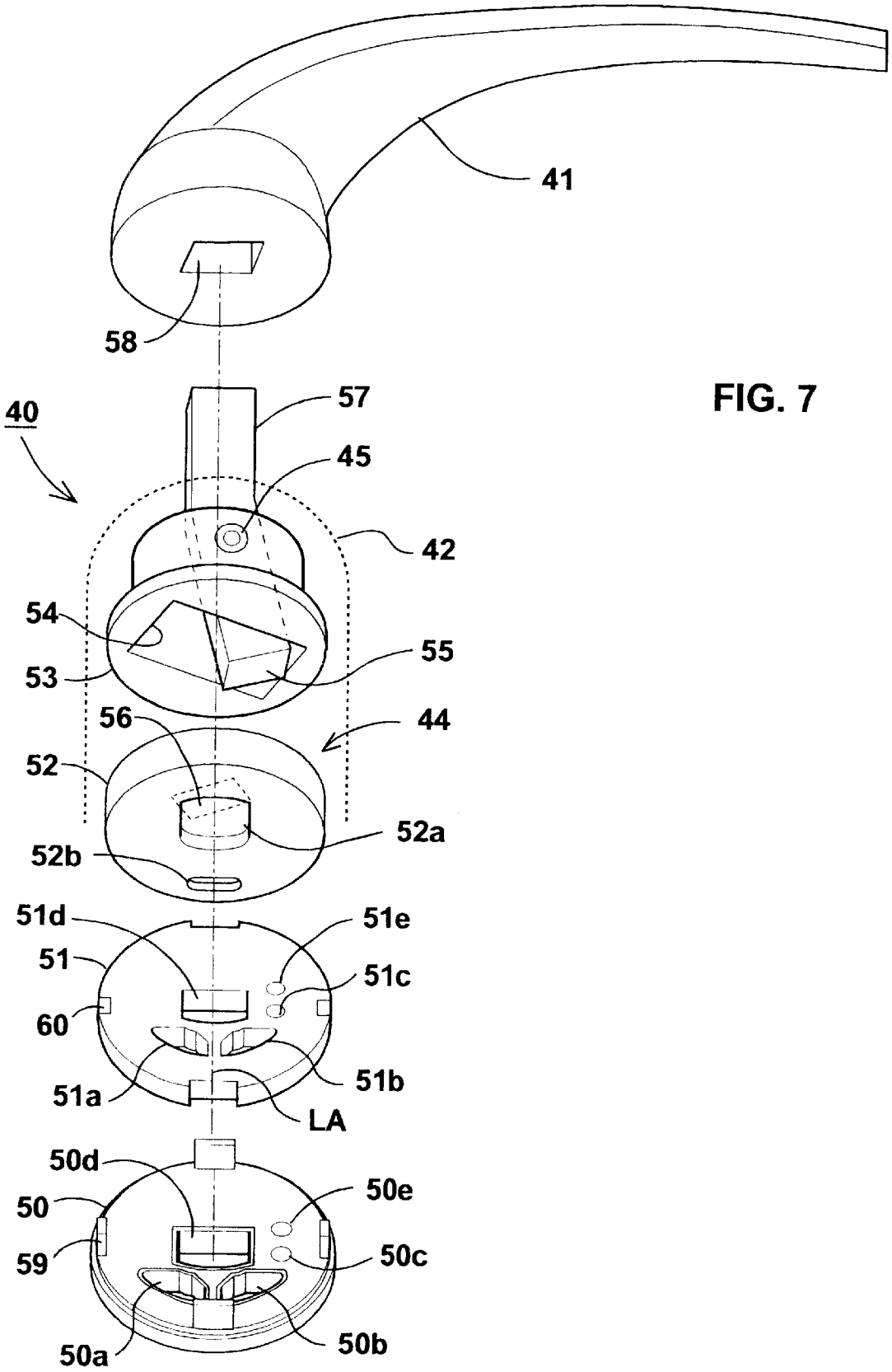
FIG. 7 is an exploded view of a further embodiment of the present invention.
Figure 8:
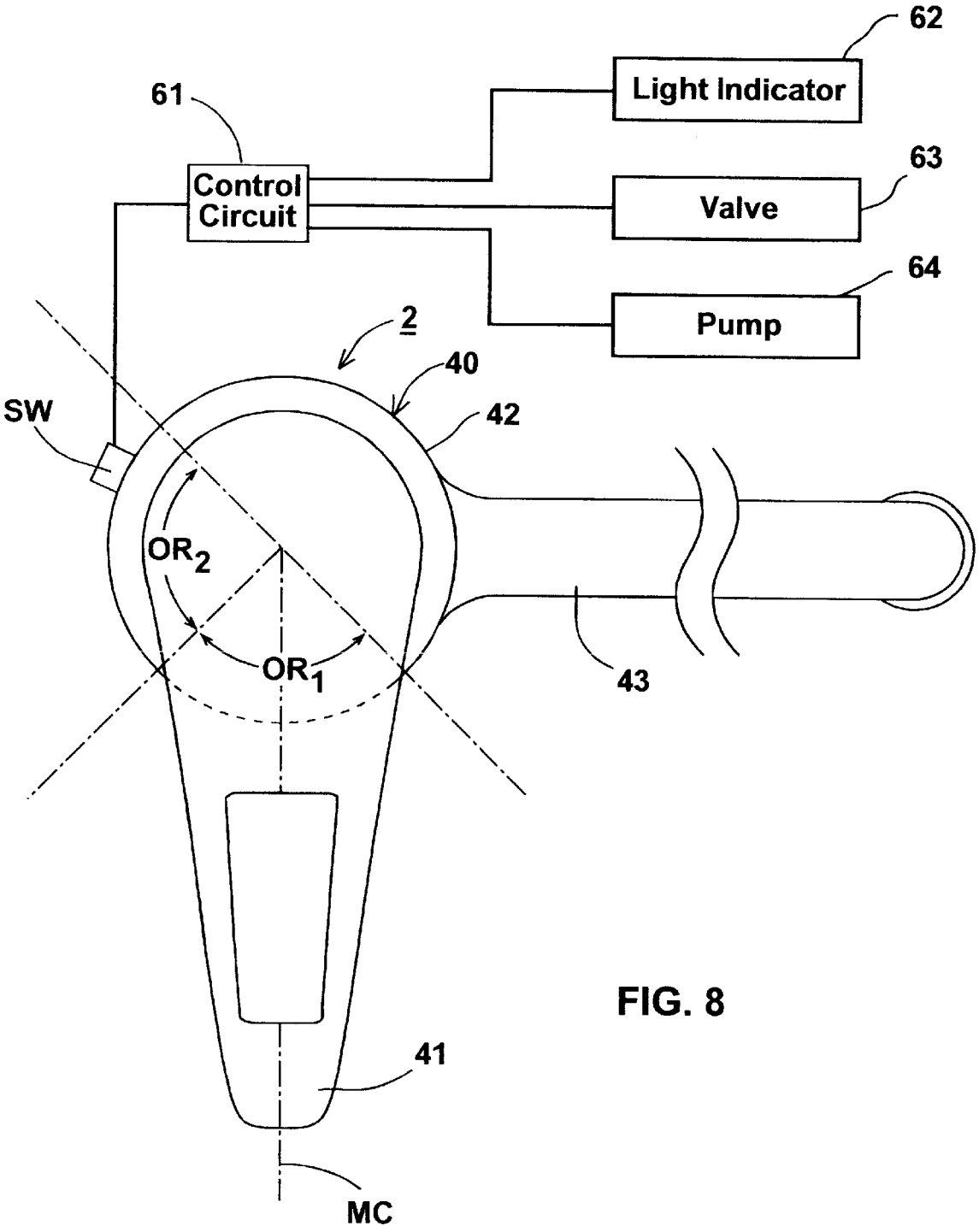
FIG. 8 is a top plan view of the water tap of FIG. 7.

FIGS. 7 and 8 illustrate a water tap, therein generally designated 40, of similar construction as in FIGS. 1 and 2, except the handle 41 is selectively movable to control the discharge of not only of hot water and cold water, but also of the third liquid, such as treated or filtered water, carbonated water, a beverage, or the like.

The water tap illustrated in FIGS. 7 and 8 includes a body member, schematically indicated at 42 in FIG. 7, fixedly attachable to the kitchen sink. Body member 42 includes a mixing chamber, corresponding to mixing chamber 6 in FIG. 1, for mixing the hot and cold water supplied from thier respective supply lines before passing the water via a spout 43, corresponding to spout 7 in FIG. 1, to a discharge nozzle at the end of the spout, corresponding to nozzle 8 in FIG. 1. Spout 7 also includes a second nozzle, corresponding to nozzle 14 in FIG. 1, for discharging the third liquid from the water tap.

A valve assembly, generally designated 44 in FIG. 7, is included within housing 42 and is coupled to handle 41 such as to control the type and flow rate of the liquid dispensed from the two nozzles in spout 43. Thus, as shown in FIG. 8, handle 41 is rotatble with respect to body member 42 to two operating regions $OR_1$, $OR_2$. When handle 41 is rotated within the operating region $OR_1$, it dispenses water from the hot and cold water supply lines and controls their respective proportions to thereby control the temperature of the dispensed water; whereas when handle 41 is rotated within the operating region $OR_2$, it dispenses the third liquid (e.g., treated water) from the spout 43.

Handle 41 is also pivotally mounted to body member 42 about axis 45 (FIG. 7) extending transversely of the body member. The arrangement is such that in either operating region $OR_1$, $OR_2$, the handle 41 may be pivotted about axis 45 to also control the flow rate of the water discharged via spout 43.

The construction of valve assembly 44 within body member 42 is more particularly illustrated in FIG. 7. Thus, body member 42 includes a fixed base plate 50, a fixed disk 51 thereover, a rotatable disk 52 overlying disk 51, and a top disk 53 overlying the rotatble disk 52. The top disk 53 is formed with a rectangular opening 54 which receives one end of a lever arm 55 of rectangular cross-section and pivotally mounted about transverse axis 45. Lever arm 55 extends through opening 54 into a rectangular recess 56 formed in the rotatble disk 52. The opposite end 57 of lever arm 55 projects through body member 42 and is received within a rectangular opening 58 formed in handle 41.

The arrangement is such that handle 41 may be rotated about the longitudinal axis LA of body member 42; and when so rotated, it also rotates lever arm 55, and thereby disks 53 and 52, by virtue of opening 54 in disk 53 and recess 56 in disk 52. In addition, handle 41 may also be pivotted about the transverse axis 45, and when so pivotted, it moves both disks 53 and 52 transversely with respect to body member 42. Disk 51 is fixed to the base plate 50 against movement with respect thereto, by lugs 59 in the base plate received within recesses 60 in disk 51, so that disk 51 is stationary with the base plate 50 during the foregoing rotational and transverse movements of disks 52 and 53 by handle 41.

Base plate 50 is formed with a hot water inlet 50*a* connectable to the hot water supply line (e.g., 4*a*, FIG. 1); a cold water inlet 50*b* connectable to the cold water supply line (e.g., 5*a*, FIG. 1); and a treated water inlet 50*c* connectable to the treated water supply line (e.g., 10*a*, FIG. 1). Base plate 50 is further formed with a large rectangular outlet opening 50*d* defining the mixing chamber (e.g., 6, FIG. 1) communicating with one of the nozzles (8, FIG. 1); and a treated water outlet 50*e* communicating with the other nozzle (e.g., 14, FIG. 1).

Disk 51 fixed to the base plate 50 is formed with inlet openings 51*a*, 51*b*, 51*c* corresponding to openings 50*a*, 50*b*, 50*c*, respectively, and in alignment with them. Disk 51 is also formed with outlet openings 51*d*, 51*e* corresponding to and aligned with the outlet openings 50*d* and 50*e*, respectively, in base plate 50.

Rotatable disk 52, which as described above is coupled to handle 41 for rotational and transverse movements, is formed with a first recess 52*a* located to bridge the two inlet openings 51*a*, 51*b* and outlet opening 51*d*, and a second recess 52*b* located to bridge inlet opening 51*c* with outlet opening 51*e*. Both disks 51 and 52 are made of ceramic material so as to facilitate the rotational and transverse movements of disk 52 with respect to disk 51.

The operation of the water tap illustrated in FIGS. 7 and 8 will now be described with reference to FIGS. 9, 9*a*, 9*b* and 9*c*.

Figure 9:
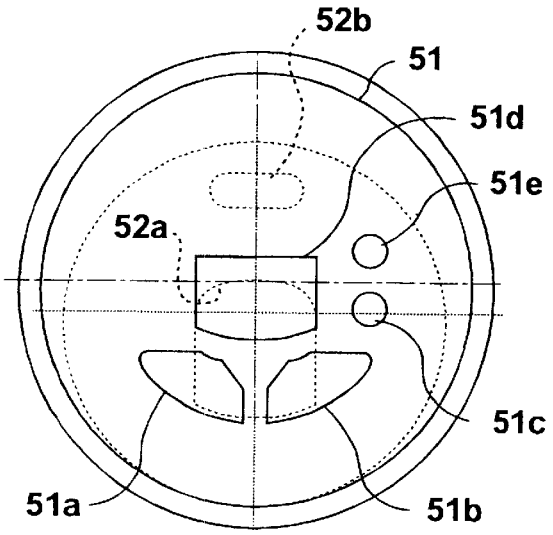
FIGS. 9. 9*a*, 9*b*, and 9*c* illustrate the operation of the water tap of FIGS. 7 and 8.

FIG. 9 illustrates the position of disk 51 when the handle 43 is in its middle position within operating range $OR_1$ (FIG. 8), and is pivoted to its fully-open position about the transverse axis 45 (FIG. 7). In this position of the handle, the large rectangular opening 52*a* in the rotatable disk 52 equally bridges the hot water inlet opening 51*a* and the cold water inlet opening 51*b*, so that equal amounts of hot and cold water are fed to the rectangular opening, serving the mixing chamber (6, FIG. 1). Accordingly, in the position of handle illustrated in FIG. 8, equal amounts of hot and cold water will be fed to the mixing chamber, and from there, through the spout 43 to the respective discharge nozzle (e.g., 8, FIG. 1).

It will be noted that in this position of the handle, recess 52*b* of the rotatable disk 52 is not aligned with either of the treated water openings 51*c*, 51*e*, and therefore the disk will block the flow of treated water to the spout 43.

Figure 9A:
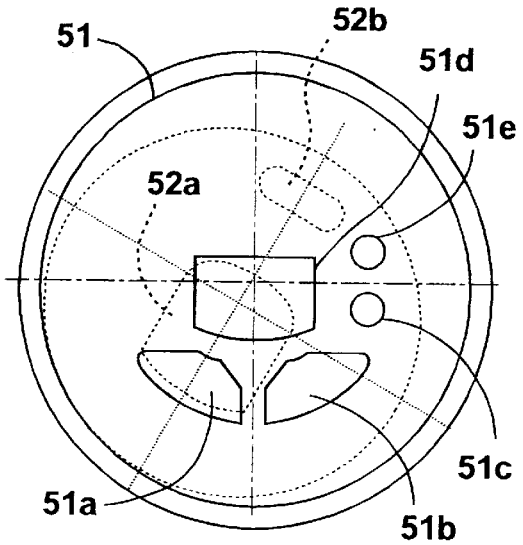
Figure 9B:
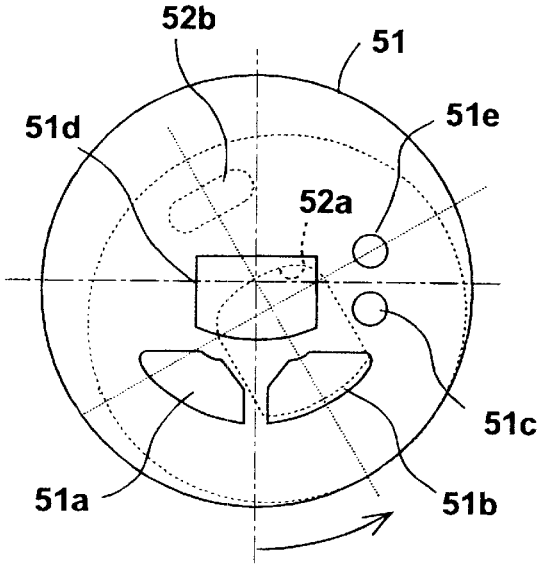

FIG. 9*a* illustrates the position of rotatable disk 52 relative to the fixed disk 51 when the handle 41 is moved clockwise; whereas FIG. 9*b* illustrates the relative positions of the two disks when the handle is moved counter-clockwise. In the former case as illustrated in FIG. 9*a*, more heated water is directed into recess 52*a*, constituting the mixing chamber, thereby increasing the temperature of the water discharged from the spout; whereas in the latter case as illustrated in FIG. 9*b*, more cold water is directed into the mixing chamber, thereby decreasing the temperature of the discharged water.

In both cases, the rate of feed of the water can be decreased by pivotting handle 41 about transverse axis 45, to thereby shift rotatable disk 52 transversely with respect to fixed disk 51, to decrease the cross-sectional areas of the two inlet openings 51*a*, 51*b* bridged by recess 52*a* with the outlet opening 51*b*.

Figure 9C:
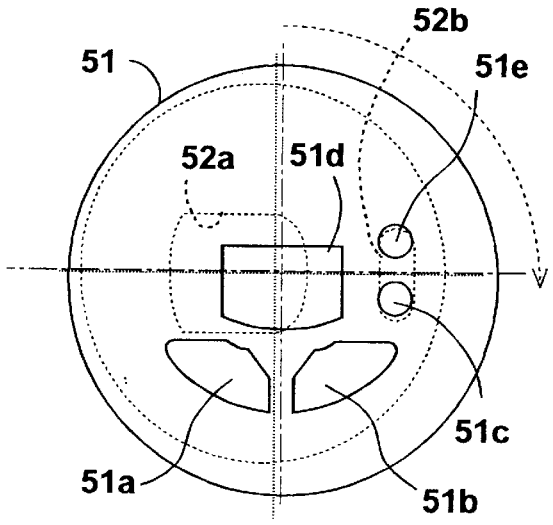

When it is desired to dispense only the treated water, handle 41 is rotated clockwise so as to move into the operating region $OR_2$ (FIG. 8). FIG. 9*c* illustrates the position of rotatable disk 52 relative to the fixed disk 51 in this position of the handle 41, wherein it will be seen that recess 52*b* now bridges the treated water inlet opening 51*c* with the treated water outlet opening 51*e*, thereby directing the treated water to the spout 43 where it is discharged from its respective nozzle (14, FIG. 1). It will also be seen that in this position of the handle, neither of the inlet openings 51*a*, 51*b* is bridged by recess 52*a*, so that neither the hot water, nor the cold water, nor a mixture of the two, is directed to the spout 43 for discharge from its respective nozzle (e.g., 8, FIG. 1).

It will also be seen that in the position of the handle illustrated in FIG. 9*c*, the handle may also be pivotted about its transverse axis 45 to decrease the cross-sectional areas of the two openings 51*c*, 51*e*, and thereby decrease the rate of the treated water to its respective discharge nozzle.

As further shown in FIG. 8, body member 42 includes an electrical switch SW which is actuated when handle 41 is within the operating region $OR_2$. Switch SW actuates a control circuit 61 for controlling a light indicator 62, a valve 63, and/or a pump 64, in the same manner, and for the purpose, as described above with respect to FIG. 1.

While the invention has been described with respect to several embodiments, it will be appreciated that these are set forth merely for purposes of example, and that many other variations, modifications and applications of the invention may be made.

What is claimed is:

1. A water tap particularly for kitchen sinks, comprising:

a body member attachable to the kitchen sink and having first and second ports for connection to hot and cold water supply lines, respectively, of the kitchen sink;

a spout for discharging water from the tap;

a mixing chamber having an inlet communicating with said first and second ports for mixing the water therefrom, and an outlet communicating with said spout;

a third port for connection to a third water supply line;

a valve assembly for selectively controlling the discharge of water from said mixing chamber and third port through said spout;

and a handle rotatably mounted about a longitudinal axis with respect to said body member and operatively connected to said valve assembly such that:

(a) rotating the handle to a selected position within a first operating region connects the first and second ports to the mixing chamber and controls the proportions of the hot and cold water supplied to said mixing chamber from the respective hot and cold water supply lines for discharge through said spout; and (b) rotating the handle to a selected position within a second operating region connects said third port to the spout for discharging through the spout water from the third water supply line.

2. The water tap according to claim 1, wherein said handle is also pivotally mounted about a transverse axis with respect to said body member, and is operatively connected to said valve assembly such as to control, by its pivotal movement, the flow rate of the water flow from said mixing chamber to said spout when the handle is in said first operating region.

3. The water tap according to claim 2, wherein said handle is operatively connected to said valve such as to control, by its pivotal movement, also the flow rate of the water flow from said third inlet port to said spout when the handle is in said second operating region.

4. The water tap according to claim 1, wherein said valve assembly includes:

a fixed member having a first inlet opening communicating with said first port, a second inlet opening communicating with said second port, a third inlet opening communicating with said third port, a first outlet opening communicating with said spout via said mixing chamber, and a second outlet opening communicating directly with said spout;

and a rotatable member coupled to said handle for rotation thereby and having a first recess located to bridge said first and second inlet openings and said first outlet opening when the handle is in said first operating region, and a second recess located to bridge said third inlet opening and said second outlet opening when the handle is in said second operating region.

5. The water tap according to claim 4, wherein said handle is also pivotally mounted about a transverse axis with respect to said body member, and is operatively connected to said valve assembly such as to control, by its pivotal movement, the flow rate of the water flow from said mixing chamber to said spout when the handle is in said first operating region.

6. The water tap according to claim 4, wherein said handle is operatively connected to said valve such as to control, by its pivotal movement, also the flow rate of the water flow from said third inlet port to said spout when the handle is in said second operating region.

7. The water tap according to claim 1, wherein said spout comprises:

a first nozzle connected by a first passageway to said mixing chamber via said valve assembly;

and a second nozzle connected by a second passageway via said valve assembly to said third port.

8. The water tap according to claim 7, wherein said first nozzle is carried by a spray head removable from the end of the spout and connected to said mixing chamber by an extensible hose extending through said spout.

9. The water tap according to claim 1, wherein said water tap further includes an electrical switch actuated by said valve assembly when said handle is in said second operating region.

10. The water tap according to claim 9, wherein said water tap further includes a light indicator which is energized by said electrical switch to indicate when said handle is in said second operating region.

11. The water tap according to claim 9, wherein said water tap further includes an electromagnetically-operated valve which is energized to control said third liquid supply line when said handle is in said second operating region.

12. The water tap according to claim 9, wherein said water tap further includes a pump which is energized to pump third liquid from said third liquid supply line when said handle is in said second operating region.

13. A water tap particularly for kitchen sinks, comprising:

a body member attachable to the kitchen sink and having first and second ports for connection to hot and cold water supply lines, respectively, of the kitchen sink;

a spout for discharging water from the tap;

a mixing chamber having an inlet communicating with said first and second ports for mixing the water therefrom, and an outlet communicating with said spout;

a third port for connection to a third liquid supply line;

manual valve means for selectively controlling the discharge of water from said mixing chamber and third port through said spout;

an electrical switch actuated by said valve means when selecting the discharge of water from said third port;

and an electrical circuit actuated by said electrical switch in response to said selection.

14. The water tap according to claim 13, wherein said electrical circuit includes a light indicator which is energized to indicate when said manual valve means has been operated to produce a discharge of said third liquid.

15. The water tap according to claim 13, wherein said electrical circuit includes an electromagnetically-operated valve which is energized to control said third liquid supply line when said manual valve means has been operated to produce a discharge of said third liquid.

16. The water tap according to claim 15, wherein said electrical circuit includes a pump which is energized to pump said third liquid from said third liquid supply line to said third liquid port when said manual valve means has been operated to produce a discharge of said third liquid.

17. The water tap according to claim 13, wherein said spout carries a first discharge nozzle connected to said mixing chamber via said valve means, and a second discharge nozzle connected to said third port via said valve means.

18. The water tap according to claim 17, wherein said first nozzle is carried by a spray head removable from the end of the spout and connected to said mixing chamber by an extensible hose extending through said spout.

19. The water tap according to claim 17, wherein said tap further includes a fourth port for connection to a fourth supply line selectively connectable to said spout by said valve means.

20. The water tap according to claim 19, wherein said valve means comprises first, second, third and fourth manually controlled valves for said first, second, third and fourth ports, respectively.

* * * * *